United States Patent [19]

Hori et al.

[11] 4,142,894

[45] Mar. 6, 1979

[54] METHOD FOR FORMING IMAGES

[75] Inventors: Kiyotaka Hori; Takeshi Mikami; Takushi Miyazako; Kenji Naito, all of Minami-ashigara, Japan

[73] Assignee: Fuji Photo Film Co., Ltd., Minami-ashigara, Japan

[21] Appl. No.: 814,239

[22] Filed: Jul. 8, 1977

[30] Foreign Application Priority Data

Jul. 8, 1976 [JP] Japan ..... 51-81143

[51] Int. Cl.[2] ..... G03C 5/24; G03C 7/16; G03C 1/76; G03C 1/31

[52] U.S. Cl. ..... 96/63; 96/22; 96/67; 96/74; 96/87 A; 96/95; 96/114; 96/114.4; 96/66 T

[58] Field of Search ..... 96/22, 63, 74, 67, 87 A, 96/114.4, 114, 95, 66 T

[56] References Cited

U.S. PATENT DOCUMENTS

| | | | |
|---|---|---|---|
| 2,322,037 | 6/1943 | Lindquist | 96/87 A |
| 2,391,181 | 12/1945 | Minsk et al. | 96/67 |
| 2,893,867 | 7/1959 | Dawson et al. | 96/66 R |
| 2,992,101 | 7/1961 | Jelley et al. | 96/74 |
| 3,062,674 | 11/1962 | Houck et al. | 96/87 R |
| 3,361,565 | 1/1968 | Umberger et al. | 96/74 |
| 3,502,473 | 3/1970 | Snellman et al. | 96/67 |
| 3,767,448 | 10/1973 | Hutton | 96/87 R |
| 3,811,924 | 5/1974 | Gallagher et al. | 96/67 |
| 3,877,942 | 4/1975 | Nagatomo | 96/67 |
| 3,923,517 | 12/1975 | Yamamoto | 96/66 R |
| 4,021,245 | 5/1977 | Nagatomo et al. | 96/50 PL |

*Primary Examiner*—Mary F. Kelley
*Attorney, Agent, or Firm*—Sughrue, Rothwell, Mion, Zinn and Macpeak

[57] ABSTRACT

A method for forming images which comprises processing a silver halide color photographic light-sensitive element containing in the uppermost layer thereof a matting agent composed of methyl methacrylate-methacrylic acid copolymers having a methyl methacrylate/methacrylic acid molar ratio of 6:4 to 9:1 at a temperature above about 30° C. The matting agent is capable of being dissolved into alkaline processing solutions and does not adversely affect the transparency and graininess of the images formed.

9 Claims, No Drawings

METHOD FOR FORMING IMAGES

BACKGROUND OF THE INVENTION

1. Field of the Invention

The present invention relates to a method for forming images using a silver halide color photographic light-sensitive element and more particularly to a method for forming images using a silver halide color photographic light-sensitive element (hereinafter referred to as a color light-sensitive element) containing in the uppermost layer thereof a polymeric matting agent.

2. Description of the Prior Art

A color light-sensitive element, in general, has an uppermost (or a surface) layer containing as a binder an organic hydrophilic colloid, of which gelatin is representative. The surface of the element, therefore, may easily adhere to the surface of other objects when contacted therewith under high temperature and humidity conditions since the adhesiveness or stickiness thereof may be increased under such conditions.

This adhesion phenomenon may take place between color light-sensitive elements, or between a color light-sensitive element and an object contacted therewith during production, storage, photographing, projection or storage after processing, and often causes serious difficulties.

In order to solve this problem, it is well known in the art to reduce the adhesive property of light-sensitive elements by coarsening (the so-called matting) the surface thereof by incorporating fine particles of inorganic materials such as silicon dioxide, manganese oxide, titanium dioxide, calcium carbonate, etc., or organic materials such as poly(methyl methacrylate), cellulose acetate propionate, etc., into the uppermost layer thereof.

In color light-sensitive elements, the use of larger quantities of matting agents is required since they have a markedly higher tendency to adhere during production, storage before processing and photographing thereof, as compared with black-and-white light-sensitive elements, presumably because they, in contrast to ordinary black-and-white light-sensitive elements, contain a number of additives, such as a color coupler, etc., in the photographic layers thereof.

The use of a large quantity of matting agents, however, may result in the formation of aggregates in coating solutions containing matting agents, and these aggregates may cause undesirable side-effects such as a disturbance of uniform coating thereof, a formation of a haze in the processed light-sensitive elements, an impairment of the transparency of the images formed, and a deterioration of the graininess of the images.

It has, therefore, been strongly desired to develop a matting agent which does not give rise to these undesirable side-effects.

In addition, it has also been strongly desired in the processing of color light-sensitive elements to achieve additionally an advance in the so-called rapid processing technique whereby the processing thereof is completed in a shorter time.

SUMMARY OF THE INVENTION

Therefore, an object of the invention is to provide a method for forming images, which comprises a rapid processing of a color light-sensitive element containing a matting agent which does not form aggregates in coating solutions even when the matting agent is used in a large quantity and which does not adversely affect the transparency and the graininess of the images after processing.

A further object of the invention is to provide a method for processing a color light-sensitive element containing a matting agent as described above.

A still further object of the invention is to provide a color light-sensitive element containing a matting agent as described above.

These objects of the invention in one embodiment are accomplished by a method for forming images which comprises processing a color light-sensitive element containing in the uppermost layer thereof, for example, in a protective surface layer, a matting agent comprising fine particles of methyl methacrylate/methacrylic acid copolymers, in which the methyl methacrylate/methacrylic acid molar ratio is 6:4 to 9:1, at a temperature above about 30° C., preferably above 35° C.

DETAILED DESCRIPTION OF THE INVENTION

The matting agent used in the invention which comprises a copolymer of methyl methacrylate (hereinafter referred to as "MMA") and methacrylic acid (hereinafter referred to as "MAA") with a molar ratio of 6:4 to 9:1 does not form aggregates in coating solutions even when the copolymer is used in a large quantity.

In addition, when the light-sensitive element containing the matting agent in the uppermost layer thereof is processed using an ordinary color developer at a temperature higher than about 30° C., preferably higher than 35° C., all of the matting agent dissolves into a processing solution, e.g., a developing solution, and, hence, does not remain in the element after processing. The matting agent, therefore, does not impair the transparency and the graininess of the images formed.

A technique in which a copolymer of the MMA/MAA type is used as an alkaline-soluble matting agent as in this invention is described, for example, in U.S. Pat. Nos. 2,992,101 and 3,767,448. In U.S. Pat. No. 2,992,101, however, an MMA/MAA copolymer having an MMA/MAA molar ratio of 1:1 is used as the matting agent, and the use of such a copolymer as a matting agent suffers from the disadvantage that a fairly large amount, e.g., about 80% by weight, of the matting agent may be dissolved when it is exposed to a fairly high temperature, e.g., about 40° C. for 30 minutes, during the coating and drying steps of the coating solution containing the matting agent in the production of light-sensitive elements. The matting property of the surface of the light-sensitive elements is thus insufficient, compared with the quantity of the matting agent incorporated thereinto.

In order to remove this disadvantage, U.S. Pat. No. 3,767,448 discloses a technique comprising the use of a de-ashed or de-ionized gelatin in the case where a copolymer of MMA and MAA with an MMA/MAA molar ratio of about 1:1 is used as the matting agent.

According to the disclosure in U.S. Pat. No. 3,767,448, the dissolving of the matting agents comprising a copolymer having free carboxyl groups in the coating step is due to the presence of calcium ions in the gelatin, and therefore, a de-ionized or de-ashed gelatin must be used therein.

However, it is extremely disadvantageous in practice to use a de-ionized or de-ashed gelatin because such a gelatin generally not only lacks coatability and tends to form aggregates or the so-called "repelled spots", but the cost of gelatin is increased by such treatments.

On the other hand, the matting agent used in the present invention, which has an MMA/MAA molar ratio of 6:4 to 9:1, does not dissolve at the coating step and is capable of providing sufficient matting properties presumably due to the increased amount of MMA in the copolymer. There is, therefore, no need to impose particular restrictions on the kind of gelatin used. This can be of great advantage for the production of light-sensitive elements.

The matting agent used in the invention which is a copolymer of MMA and MAA can be prepared using conventional methods. Reference may be made to the methods of synthesis described, for example, in U.S. Pat. Nos. 2,322,037, 2,391,181 and 2,992,101. The copolymers have an MMA/MAA ratio of 6:4 to 9:1, preferably 6:4 to 8:2, and a molecular weight of about 10,000 to about 1,000,000, preferably 50,000 to 200,000.

The matting agent used for the color light-sensitive element of the invention may have a particle size of about 0.2 to about 10$\mu$, particularly 0.5 to 5$\mu$, although the size can be arbitrarily varied over a fairly wide range in the synthesis thereof.

In the color light-sensitive element of the invention, the matting agent is incorporated into the uppermost layer thereof. For example, the matting agent can be incorporated into either a protective surface layer or a backing layer, or into both of these layers. It is most preferable, however, to incorporate the matting agent into a protective surface layer.

In the color light-sensitive element of the invention, the matting agent is incorporated preferably in an amount of about 50 to about 500 mg, preferably 100 to 300 mg, per square meter of the uppermost layer thereof.

Although the type of binder for the uppermost layer is not particularly limited in the color light-sensitive element of the invention, gelatin is most preferably used as the binder. Examples of gelatins which can be used for the binder include the so-called alkali-, acid- or enzyme-processed gelatins, gelatin derivatives, modified gelatins, and the like. Of the types of gelatins, acid-processed gelatin can be used most preferably.

Various additives, such as hardeners, lubricants, surface active agents, thickeners, antistatic agents, polymeric latexes, and the like may be incorporated in the uppermost layer of the light-sensitive element of the invention.

Examples of useful hardeners include aldehydes, active halogen-containing compounds, such as 2-hydroxy-4,6-dichloro-1,3,5-triazine, etc., vinylsulfones, N-methylol compounds and halocarboxyaldehydes, such as mucochloric acid, etc.

Examples of useful lubricants include liquid paraffin, waxes, polyfluorohydrocarbons, silicones, and the like.

Examples of useful surface active agents include naturally-occurring surfactants, such as saponin, etc., nonionic surfactants, such as alkylene oxides, etc., cationic surfactants, such as higher alkylamines, quaternary ammonium compounds, etc., and anionic surfactants, e.g., those containing acidic groups such as carboxylic and sulfonic acid groups.

Examples of useful antistatic agents include surface active agents as described above, alkali metal salts of styrene-maleic acid copolymers or acrylonitrile-acrylic acid copolymers, and those described in U.S. Pat. Nos. 3,206,312 and 3,428,451.

In addition to the matting agent according to the invention, the uppermost layer of the color light-sensitive element of the invention may contain other matting agents usually used in the art, such as fine particles of silicon dioxide, poly(methyl methacrylate), and the like. These conventional matting agents, however, must be used within a restricted quantity, e.g., in an amount of up to about 50 mg/m$^2$, preferably 5 to 10 mg/m$^2$, since, in most cases, they remain in the light-sensitive element after processing. A suitable thickness for the backing layer is about 1 to about 15$\mu$, preferably 2 to 10$\mu$.

The thickness of the uppermost layer of the color light-sensitive element used in the present invention is not particularly limited, but preferably ranges from about 0.2 to about 10$\mu$, particularly 0.5 to 3$\mu$.

A description will be given hereinafter as to embodiments, other than the uppermost layer, of the color light-sensitive element used in the invention.

Silver halide emulsions used in the invention can be prepared by any of the conventional methods, including single jet, double jet and controlled double jet methods, and acidic, ammoniacal and neutral methods. The form, size and size distribution of the silver halide grains are not particularly restricted.

Any of silver chloride, silver bromide, silver iodobromide and silver chloroiodobromide may be used as the silver halide.

Suitable binders for the silver halides and for the uppermost layer as well which may be used include gelatin, modified gelatins and gelatin derivatives, or combinations of gelatins as described above and other polymers, such as carboxymethyl cellulose, hydroxyethyl cellulose, starch derivatives, polyvinyl alcohol, poly-N-pyrrolidone, polyacrylic acid copolymers, polyacrylamide, and the like. Latexes of vinyl copolymers dispersable into water may also be used in the photographic layers of the color light-sensitive element. Examples of such latexes include homo- and copolymers of alkyl acrylates, alkyl methacrylates, acrylic acid, methacrylic acid, glycidyl acrylate, styrene, vinyl chloride, vinylidene chloride, and the like.

The silver halide emulsions used in the invention can be chemically sensitized using conventional methods by using, for example, gold compounds, such as those described in U.S. Pat. Nos. 2,399,083 and 2,597,856; salts of noble metals, such as platinum, palladium, rhodium and iridium; sulfur compounds, such as those described in U.S. Pat. Nos. 2,410,689 and 3,501,313; stannous salts; amines; and the like.

The silver halide emulsions used in the color light-sensitive element according to the invention can contain various compounds which are generally referred to in the art as stabilizers or anti-foggants. Examples of such compounds include heterocyclic compounds, mercury-containing compounds, mercapto compounds and metal salts, including 4-hydroxy-6-methyl-1,3,3$\alpha$,7-tetrazaindene, 3-methyl-benzotriazole and 1-phenyl-5-methylmercaptotetrazole.

The silver halide emulsions used in the invention can also contain various spectral sensitizers selected in accordance with the purpose thereof, including merocyanine dyes, carbocyanine dyes, cyanine dyes, and the like.

Couplers such as diketomethylene yellow couplers of the 4-equivalent type, diketomethylene yellow couplers of the 2-equivalent type, and pyrazolone magenta couplers, indazolone magenta couplers, $\alpha$-naphthol cyan couplers and phenol cyan couplers of the 2- or 4-equivalent type, and the so-called DIR couplers may be used as well in the color light-sensitive element of the invention.

The silver halide emulsion layers and other photographic layers of the color light-sensitive element used in the invention can additionally contain other additives, such as dyes, UV-absorbents, hardeners as described above, surface active agents, and polymer latexes.

Any of the supports which are usually used in the photographic art can be used as the support for the color light-sensitive element of the invention. Examples of useful supports include cellulose acetate films, poly(ethylene terephthalate) films, and paper coated with baryta or $\alpha$-olefin polymers.

The photographic layers of the color light-sensitive element of the invention can be coated using various methods, such as dip coating, air knife coating, curtain coating and extrusion coating. If desired, two or more layers can be coated simultaneously.

Examples of additives, binders, supports and coating procedures which can be used in the invention are disclosed in *Product Licensing Index,* Vol. 92, pp. 107 to 110 (December, 1971).

Exposure of the color light-sensitive element of the invention can be carried out by using any light sources, including those providing a high level of exposure to a low level of exposure, for a time of from several tens of minutes to about $10^{-6}$ seconds.

After exposure, the color light-sensitive element of the invention is processed to form color images.

The processing essentially includes at least one color development step, and optionally a pre-hardening step, a neutralization step, a first development (or black-and-white development) step, and the like. These and the following steps (e.g., combinations of steps comprising bleaching, fixing, bleach-fixing, intensifying, stabilizing and washing) can be carried out preferably at a temperature above about 30° C., particularly above 35° C.

The above-described steps, however, do not need to be carried out at the same temperature. In particular, the steps other than color development can be carried out at a temperature below about 30° C.

If the color development step is not carried out at a temperature above about 30° C., the matting agent comprising MMA/MAA copolymers according to the invention will not be dissolved sufficiently and will adversely affect the transparency and the graininess of the images after processing, so that the effects of the invention will not be fully achieved.

The color development solution is an aqueous solution containing p-phenylenediamines (e.g., N,N-diethyl-p-phenylenediamine, N,N-diethyl-3-methyl-p-phenylenediamine, 4-amino-3-methyl-N-ethyl-N-methanesulfoamidoethylaniline, 4-amino-3-methyl-N-ethyl-N-$\beta$-hydroxyethylaniline, N-ethyl-N-$\beta$-hydroxyethyl-p-phenylenediamine, etc.) or the salts thereof (e.g., hydrochlorides, sulfates, sulfites, etc.) as a color developer or a compound, the oxidation product of which is capable of reacting with a color-forming agent (or color coupler) to form a colored product. The color developing solution has a pH above about 8, preferably from 9 to 12. It is also possible to use, as a color developer, compounds such as those described, for example, in U.S. Pat. Nos. 2,193,015 and 2,592,364, and Japanese Patent Application (OPI) No. 64,933/73. The color development solutions can additionally contain salts, such as sodium sulfate, etc., pH-adjusting agents, such as sodium hydroxide, sodium carbonate, sodium phosphate, etc., buffers (e.g., acids, such as acetic acid or boric acid, or the salts thereof), and development accelerators (e.g., pyridinium compounds, such as those described, for example, in U.S. Pat. Nos. 2,648,604 and 3,671,247; cationic compounds; sodium or potassium nitrate; polyethylene glycol condensates or derivatives thereof, such as those described, for example, in U.S. Pat. Nos. 2,533,990, 2,577,127 and 2,950,970; nonionic compounds such as polythioethers of which those described in British Pat. Nos. 1,020,033 and 1,020,032 are representative; polymers containing sulfite esters, such as those described in U.S. Pat. No. 3,068,097; organic amines, such as pyridine, ethanolamine, etc.; benzylalcohol, hydrazine; and the like). The color development solutions can also contain anti-foggants (e.g., alkali metal bromides, alkali metal iodides, nitrobenzimidazoles, benztriazoles, mercaptotetrazoles, etc.); stain or sludge-preventing agents, such as those described, for example, in U.S. Pat. No. 3,161,514 and British Pat. No. 1,144,481; interimage effect-promoting agents, such as those described, for example, in U.S. Pat. No. 3,536,487; and preservatives (e.g., sulfites, bisulfites, hydroxylamine hydrochloride, formaldehydealkanolaminesulfite adducts, etc.).

Prior to the development step, the light-sensitive element is usually subjected to a pre-hardening, using aqueous solutions containing at least one compound which is capable of reacting with and hardening the gelatin in the photographic emulsion layers. Examples of such compounds include aldehydes, for example, aliphatic aldehydes, such as those described in U.S. Pat. No. 3,232,761, formaldehyde, glyoxal, succinaldehyde, glutaraldehyde, pyruvic aldehyde, etc; and aromatic aldehydes, such as those described in U.S. Pat. Nos. 3,565,632 and 3,677,760. The pre-hardening bath can additionally contain inorganic salts, such as sodium sulfate, etc., pH-adjusting agents or buffers, such as borax, boric acid, acetic acid, sodium hydroxide, sulfuric acid, etc., and development fog-preventing agents, such as alkali metal halides (e.g., potassium bromide, etc.), and the like.

In order to prevent the developing bath from being contaminated with aldehydes used in the pre-hardening step, a neutralizing bath is generally employed. The neutralizing bath can contain an aldehyde-removing compound, such as hydroxylamine, L-ascorbic acid, etc., and other additives, such as inorganic salts, pH-adjusting agents and buffers.

In the case of color reversal films, a first development is conducted prior to the color development. Aqueous alkaline solutions containing at least one developer such as hydroquinone, 1-phenyl-3-pyrazolidone, N-methyl-p-aminophenol, and the like can be used as the first developer. The first developer can additionally contain inorganic salts, such as sodium sulfate, etc., pH-adjusting agents or buffers, such as borax, boric acid, sodium hydroxide, sodium carbonate, etc., and development fog-preventing agents, such as alkali metal halides (e.g., potassium bromide, etc.), and the like.

The above-described additives and the quantities employed are well known in the art of color photographic processing.

After color development, the color light-sensitive element is generally subjected to a bleaching and a fixing. The bleaching and fixing can be combined into a bleach-fixing. A variety of compounds can be used in the bleaching bath, including ferricyanides, bichromates, soluble iron(III) salts, soluble cobalt(III) salts, soluble copper(II) salts, soluble quinones, nitrosophenol, complexes of an organic acid and a polyvalent cation, such as iron(II), cobalt(III), copper(II), etc., metal complexes of amino polycarboxylic acids (e.g., ethylenediaminetetraacetic acid, nitrilotriacetic acid, iminodiacetic acid, N-hydroxyethylethylenediaminetriacetic acid, etc.), malonic acid, tartaric acid, malic acid, diglycollic acid, dithioglycollic acid, etc., a complex of 2,6-dipicolinic acid and copper, peroxides (e.g., alkyl peroxides, persulfates, permanganates, hydrogen peroxide, etc.), hypochlorites, chlorine, bromine, bleaching powder (chlorinated lime), and the like. These compounds can be used either individually or in combination. The bath can additionally contain bleach accelerators, such as those described in U.S. Pat. Nos. 3,042,520 and 3,241,966; and Japanese Patent Publications Nos. 8,506/69 and 8,836/70.

The color light-sensitive element of the invention can be fixing using any known fixing solution. Ammonium, sodium or potassium thiosulfate in an amount of about 5 to about 200 g per liter of the solution can be used as the fixing agent. The fixing solution can additionally contain stabilizers, such as sulfites, metabisulfites, etc., hardeners such as potassium alum, etc., buffers, such as acetates and borates, and the like. The pH of the solution can be either higher than or less than 3.

As to bleaching agents, fixing agents and bleach-fixing baths, reference may be made to U.S. Pat. No. 3,582,322 and the like.

Those intensifying solutions employing Co(III) salts, those intensifying solutions employing hydrogen peroxide, and those intensifying solutions employing chlorites may be used as intensifying solutions.

Those solutions described, for example, in U.S. Pat. Nos. 2,515,121 and 3,140,177 can be used as image-stabilizing baths.

The following examples are given to illustrate the present invention in greater detail. Unless otherwise indicated, all parts, percents, ratios and the like are by weight.

EXAMPLE 1

Onto subbed cellulose triacetate films were coated, in succession, a red-sensitive silver halide emulsion layer, an interlayer, a green-sensitive silver halide emulsion layer, a yellow filter layer, a blue-sensitive silver halide emulsion layer and an uppermost layer to produce Samples 1 to 8.

The compositions of the above layers other than uppermost layers are shown in Table 3 below.

The uppermost layers had the compositions shown in Table 1 below and were coated at a coverage of the matting agents of 200 mg/m$^2$.

TABLE I

| Sample | Concentration of Ca Ion Contained in Gelatin Used as Binder | Emulsion | Hardener | Surface Active Agent |
|---|---|---|---|---|
| 1 | (ppm) 5,000 | a* | Mucochloric Acid | Sodium Dodecylbenzenesulfonate |
| 2 (control) | " | b** | " | " |
| 3 | " | c*** | " | " |
| 4 (control) | " | d**** | " | " |
| 5 | 50 | a* | " | " |
| 6 | " | b** | " | " |

TABLE I-continued

| Sample | Concentration of Ca Ion Contained in Gelatin Used as Binder | Emulsion | Hardener | Surface Active Agent |
|---|---|---|---|---|
| (control) | | | | |
| 7 | " | c*** | " | " |
| 8 (control) | " | d**** | " | " |

a*An emulsion prepared by dispersing an MMA-MAA copolymer having an MMA/MAA molar ratio of 6:4 of a mean particle size of 2.5 μ into an acid processed gelatin containing Ca ion at a concentration of 5,000 ppm.

b**An emulsion prepared in the same manner as in (a) above, except that an MMA-MAA copolymer having an MMA/MAA molar ratio of 5:5 was used (Control).

c***An emulsion prepareed by dispersing an MMA-MAA copolymer having an MMA/MAA molar ratio of 6:4 of a mean particle size of 2.5 μ into a de-ashed gelatin containing Ca ion at a concentration of 50 ppm.

d****An emulsion prepared in the same manner as in (c) above, except that an MMA-MAA copolymer having an MMA/MAA molar ratio of 5:5 was used (Control).

The surfaces of the thus prepared Samples 1 to 8 were evaluated using a surface coarseness meter ("Surfcon 30B", trade name, manufactured by Tokyo Seimitsu Co., Ltd.). In each of the samples, the height X in microns of the convex projection on a sample having a length of 2 mm was measured. Each measured height was squared, the mean of the squares was obtained, and then the root mean square (i.e., $\sqrt{\overline{X^2}}$) was calculated. The degree of the coarseness thereof was evaluated in five grades, ranging from A (coarse) to E (smooth) in accordance with the table below.

| $\sqrt{\overline{X^2}}$ | Grade |
|---|---|
| 0.081 μ or more | A |
| 0.061 to 0.080 μ | B |
| 0.041 to 0.060 μ | C |
| 0.021 to 0.040 μ | D |
| 0.020 μ or less | E |

The results obtained are shown in Table 2 below.

TABLE 2

| Sample No. | Coarseness |
|---|---|
| 1 | A |
| 2 (Control) | E |
| 3 | A |
| 4 (Control) | D |
| 5 | A |
| 6 (Control) | B to C |
| 7 | A |
| 8 (Control) | A |

As is clearly shown by the results in Table 2, satisfactory matting properties can be obtained, irrespective of the gelatin used for the preparation of the emulsions and the concentration of Ca ion in the gelatin binders, where the matting agent of the invention is used therein. On the other hand, the matting properties of the samples containing a matting agent having an MMA/MAA molar ratio of 5:5 (Control) are greatly affected by the concentration of Ca ion, and only poor matting properties are attained in samples containing Ca ion at a high concentration.

The samples were then imagewise exposed and subjected to the following processings.

| | Minutes |
|---|---|
| Color Development | 3 |
| Bleaching | 6 |
| Washing | 3 |
| Fixing | 6 |
| Washing | 3 |
| Stabilizing | 3 |

-continued

| Stabilizing Bath | |
|---|---|
| Formaldehyde (40% aq. soln.) | 10.0 g |
| Water to make | 1 l |

All the samples formed images having a good transparency and graininess, and no significant difference was observed between them.

TABLE 3

| | Red-Sensitive* Emulsion Layer | Blue-Sensitive* Emulsion Layer | Green-Sensitive* Emulsion Layer | Interlayer | Yellow Filter Layer |
|---|---|---|---|---|---|
| Color Coupler | 4-Chloro-1-hydroxy-N-dodecyl-2-naphthamide 0.88 g/m$^2$ | 1-(2,4,6-Trichlorophenyl)-3-[3-(2,4-di-t-amylphenoxy)-acetamido]-benzamido-5-pyrazolone 0.75 g/m$^2$ | 3'-(2,4-Di-t-amylphenoxy-acetamido)-α-4-methoxybenzoyl)-acetanilide 1.31 g/m$^2$ | — | — |
| Spectral Sensitizer | bis(9-Ethyl-5-chloro-3-β-hydroxyethyl)-thiacarbo—5.23 mg/m$^2$ 6.51 mg/m$^2$ | bis(9-Ethyl-5-phenyl-3-ethyl)oxy-carbocyanine | — —cyanine | — — | — |
| Stabilizer | 5-Hydroxy-7-methyl-1,3,8-triazaindol-idine 8.19 mg/m$^2$ | 5-Hydroxy-7-methyl-1,3,8,-triazaindol-idine 7.71 mg/m$^2$ | 5-Hydroxy-7-methyl-1,3,8-triazaindol-idine 6.50 mg/m$^2$ | — | — |
| Hardener | Sodium salt of 2,4-dichloro-6-hydroxy-1,3,5-triazine 15 mg/m$^2$ | Sodium salt of 2,4-dichloro-6-hydroxy-1,3,5-triazine 14 mg/m$^2$ | Sodium salt of 2,4-dichloro-6-hydroxy-1,3,5-triazine 20 mg/m$^2$ | Sodium salt of 2,4-dichloro-6-hydroxy-1,3,5-triazine 10 mg/m$^2$ | Sodium salt of 2,4-dichloro-6-hydroxy-1,3,5-triazine 11 mg/m$^2$ |
| Coating Aid | Sodium p-dodecylbenzene-sulfonate 42 mg/m$^2$ | Sodium p-dodecylbenzene-sulfonate 51 mg/m$^2$ | Sodium n-dodecylbenzene-sulfonate 67 mg/m$^2$ | Sodium n-dodecylbenzene-sulfonate 56 mg/m$^2$ | Sodium n-dodecylbenzene-sulfonate 63 mg/m$^2$ |
| | + | + | + | + | + |
| | Sodium p-nonyl-phenoxypoly-(ethyleneoxy)-propane-sulfonate 53 mg/m$^2$ | Sodium p-nonyl-phenoxypoly-(ethyleneoxy)-propane-sulfonate 64 mg/m$^2$ | Sodium p-nonyl-phenoxypoly-(ethyleneoxy)-propane-sulfonate 84 mg/m$^2$ | Sodium p-nonyl-phenoxypoly-(ethyleneoxy)-propane-sulfonate 71 mg/m$^2$ | Sodium p-nonyl-phenoxypoly-(ethyleneoxy)-propane sulfonate 80 mg/m$^2$ |
| Filter | — | — | — | — | Yellow colloidal silver |
| Dry Thickness | 5 μ | 6 μ | 5 μ | 2 μ | 2 μ |

*Silver halide emulsion: A silver iodobromide emulsion containing 5.5 mol % of silver iodide was used.

The processings were effected at a temperature of 38° C. The solutions had the formulations described below.

| Color Developer | |
|---|---|
| Sodium Sulfate | 2.0 g |
| Sodium Carbonate (monohydrate) | 30.0 g |
| Potassium Bromide | 2.0 g |
| Benzyl Alcohol | 5.0 ml |
| Hydroxylamine Sulfate | 1.6 g |
| 4-Amino-3-methyl-N-ethyl-N-(β-hydroxyethyl)aniline | 4.0 g |
| Water to make | 1 l |
| **Bleaching Solution** | |
| Iron-Sodium Ethylenediaminetetraacetate | 100.0 g |
| Potassium Bromide | 60.0 g |
| Ammonium Hydroxide (28% aq. soln.) | 50.0 ml |
| Glacial Acetic Acid | 25.0 ml |
| Water to make | 1 l |
| **Fixing Solution** | |
| Sodium Sulfate | 10.0 g |
| Sodium Thiosulfate | 200.0 g |
| Water to make | 1 l |

While the invention has been described in detail and with reference to specific embodiments thereof, it will be apparent to one skilled in the art that various changes and modifications can be made therein without departing from the spirit and scope thereof.

What is claimed is:

1. A method for forming images which comprises imagewise exposing and processing at a temperature above about 30° C. a coupler-containing gelatino siverhalide emulsion color photographic light-sensitive element containing in at least one of an uppermost protective surface layer and an uppermost backing layer thereof a matting agent comprising a methyl methacrylate-methacrylic acid copolymer having a methyl methacrylate to methacrylic acid molar ratio of 6:4 to 9:1, a particle size of about 0.2 to about 10μ and a molecular weight of about 10,000 to about 1,000,000.

2. The method for forming images as claimed in claim 1, wherein said copolymer is a copolymer having a methyl methacrylate to methacrylic acid molar ratio of 6:4 to 8:2.

3. The method for forming images as claimed in claim 1, wherein said processing is at a temperature of from 35° C. to 55° C.

4. The method for forming images as claimed in claim 1, wherein at least a part of the binder in said uppermost layer is an acid-processed gelatin.

5. The method for forming images as claimed in claim 1, wherein said matting agent has a particle size of about 0.5 to about 5μ.

6. The method for forming images as claimed in claim 1, wherein said uppermost layer is a protective surface layer, and said matting agent is present therein in an amount from about 50 to about 500 mg per square meter of said color photographic light-sensitive element.

7. The method for forming images as claimed in claim 1, wherein said color photographic light-sensitive element additionally contains an alkali-insoluble matting agent in combination with said matting agent.

8. The method of claim 1 wherein the copolymer has a molecular weight of about 50,000 to 200,000.

9. A method for forming images which comprises imagewise exposing and processing at a temperature above about 30° C. a coupler-containing gelatino silver-halide emulsion color photographic light-sensitive element containing in at least one of an uppermost protective surface layer and an uppermost backing layer thereof a matting agent comprising a methyl methacrylate-methacrylic acid copolymer having a methyl methacrylate to methacrylic acid molar ratio of 6:4 to 9:1, a particle size of about 0.2 to about 10μ and a molecular weight of about 10,000 to about 1,000,000 said uppermost protective or backing layer contain gelatin as a binder with up to 5,000 ppm $Ca^{30}$ ion.

* * * * *